US006006926A

United States Patent [19]

O'Reilly et al.

[11] Patent Number: 6,006,926

[45] Date of Patent: Dec. 28, 1999

[54] DISPLAY SHELVING

[75] Inventors: Robert Wheeler O'Reilly, Aurora; Leslie Ewart Neil Roger, Don Mills; Saravanan Maheswaran, Toronto, all of Canada

[73] Assignee: CDA Industries Inc., Scarborough, Canada

[21] Appl. No.: 09/146,339

[22] Filed: Sep. 2, 1998

[51] Int. Cl.[6] ..... A47F 7/16; A47F 1/04; A47F 3/14; A47B 43/00

[52] U.S. Cl. ..... 211/45; 211/59.2; 211/133.1; 211/186; 211/187

[58] Field of Search ..... 211/45, 59.2, 126.2, 211/133.1, 186, 187

[56] References Cited

U.S. PATENT DOCUMENTS

| | | | |
|---|---|---|---|
| 2,943,742 | 7/1960 | Colley | 211/59.2 |
| 3,019,907 | 2/1962 | Belejack | 211/59.2 |
| 4,531,646 | 7/1985 | Howard | 211/59.2 X |
| 5,031,781 | 7/1991 | Price et al. | 211/45 |
| 5,160,051 | 11/1992 | Bustos | 211/59.2 |
| 5,655,740 | 8/1997 | Lazarus | 211/187 X |

*Primary Examiner*—Daniel P. Stodola
*Assistant Examiner*—Erica B. Harris

[57] ABSTRACT

A floor display for products, in the form of a shelf system having a base, a back wall, side walls, and preferably having a top wall or canopy, although this is an optional feature, and shelves fitted at progressively increasing angles from bottom to top of the display for displaying products in a manner convenient for viewing.

8 Claims, 5 Drawing Sheets

DISPLAY SHELVING

FIELD OF THE INVENTION

The invention relates to a product display, for use in a retail store, and in particular for a product display shelving system for displaying vinyl tiles.

BACKGROUND OF THE INVENTION

Product display shelving and racks are available in a wide variety of constructions. Usually they are designed for displaying the maximum amount of products in a minimum space, so that the largest number of different products can be displayed within a given square footage of retail space.

Vinyl tiles are conventionally displayed by means of a plurality of vertically mounted swinging panels, usually at counter height, so that customers may easily view the panels by simply swinging them to and fro. Vinyl tiles are secured for example by adhesives on the swinging panels, although they may be releasably secured in some cases.

Such systems lend themselves to erection along the walls of a retail space, and have been popular and effective in the past.

However, it is clearly desirable, when displaying products such as vinyl tiles, that the display shall not be confined simply to the walls of the retail space.

In order to use the swinging panel system, for filling a retail space relatively substantial intermediate walls must then be erected within the retail space. These walls then tend to divide up the retail space into a number of relatively small compartments or cubicles, making it awkward for customers to move around.

In addition, the erection of such walls and swinging panels represents a substantial cost to the retail establishment. Furthermore, if the establishment wishes to re-arrange its displays, it is relatively difficult, and expensive, for the establishment to rearrange the display, or to move the panels to a different location.

For all of these reasons therefore it is desirable to provide free standing product displays which can readily be placed anywhere on the floor of a retail establishment, and, in the case of the display of vinyl tiles, will display a very large number of vinyl tiles to prospective customers, without the need for swinging vertically hinged panels to and fro.

Preferably such a free-standing display will display a large number of different tiles all of which can simply be viewed by standing in front of the display, without the customer having to move anything.

This will enable a number of customers to be able to view the display simultaneously, without interfering with one another's shopping experience or view of the display.

BRIEF SUMMARY OF THE INVENTION

With a view to providing a free standing floor display for products, the invention comprises a free-standing shelf system having a base, a back wall, side walls, and preferably having a top wall or canopy, although this is an optional feature.

The side walls are preferably provided with a large number of releasable support pins, and the shelves are formed of a uniform construction so that they may be interengaged with the pins on the side walls.

Preferably, the side walls are formed in a generally upwardly tapering fashion, having a rear edge which is linear and vertical, and having a forward edge which tapers from a wide region at the base to a narrower region at the top, and has an arcuate concave profile.

The fastenings themselves will also follow the tapering of the forward edge of the side walls, so that the support pins are closer together at the top and further apart at the bottom.

Given the fact that the shelves are of uniform shape, this will enable the lower shelves to be supported at a relatively low angle, and each successive upper shelf will then be supported at a progressively steeper angle. The product on the leading edge of each shelf will be readily visible to customers, so that customers may see an attractive display in which the shelves are arranged in a progressively increasingly angled fashion, so that the product on the lower shelves, can be viewed by simply looking downwardly at the lower shelves, whereas the product on the upper shelves is displayed at an angle of anywhere from 45 to 60 degrees, making all of the product readily visible to a customer standing in front of the display without the customer having to move anything.

In the case of vinyl tiles, this will mean that a large number of different designs of vinyl tiles can be displayed on the various shelves or trays, and the customer will then have the chance to view all of the designs displayed, while simply standing at a distance in front of the display without having to swing vertical panels, or to move around other customers who may also be shopping to select product.

The invention preferably provides shelves in the form of removable trays formed of injection moulded thermoplastic material, which have end edge walls, with formations for engaging the support pins on the side walls of the display, and there being transverse reinforcing ridges located on the underside of the tray, and retaining lip portions on the forward edge of the tray. Preferably the trays are reduced in weight by forming a plurality of holes through the surface of the tray.

The display cabinet will have side walls which are upright and linear along their rear edge, and along their forward edge are curved so that they taper from a wide region at the lower end to a narrow region at the upper end, a plurality of support pins are mounted in the side walls, and the pins at the lower wider ends of the side walls being spaced further apart and the pins are spaced progressively closer together as they continue further up the length of the side walls.

Preferably a canopy is provided on top of the side walls, so that it may carry sales promotional material, and provide a finished attractive appearance to the display.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
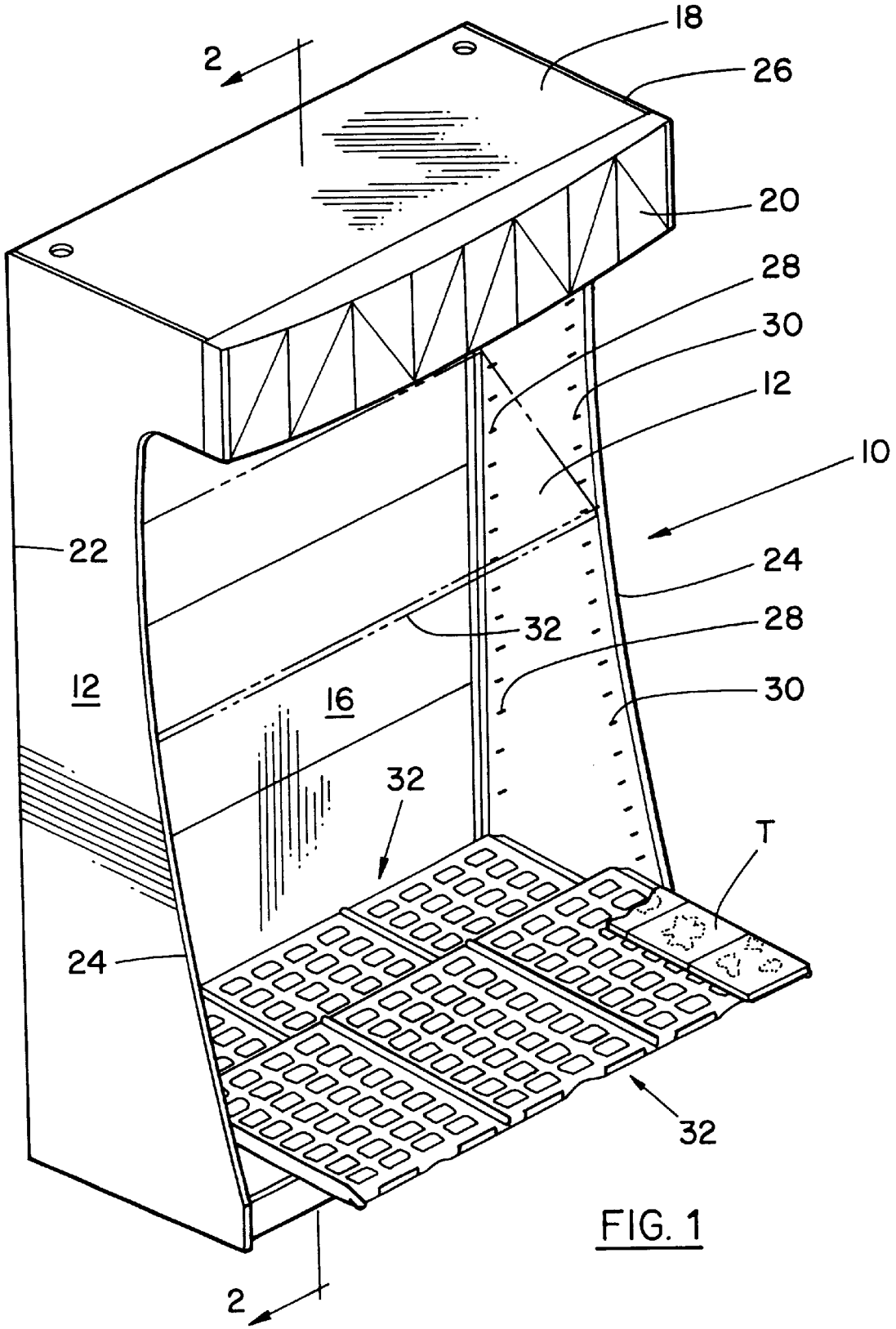
FIG. 1 is a perspective illustration of a display unit illustrating the invention, and showing some trays mounted therein and other trays in phantom.
Figure 2:
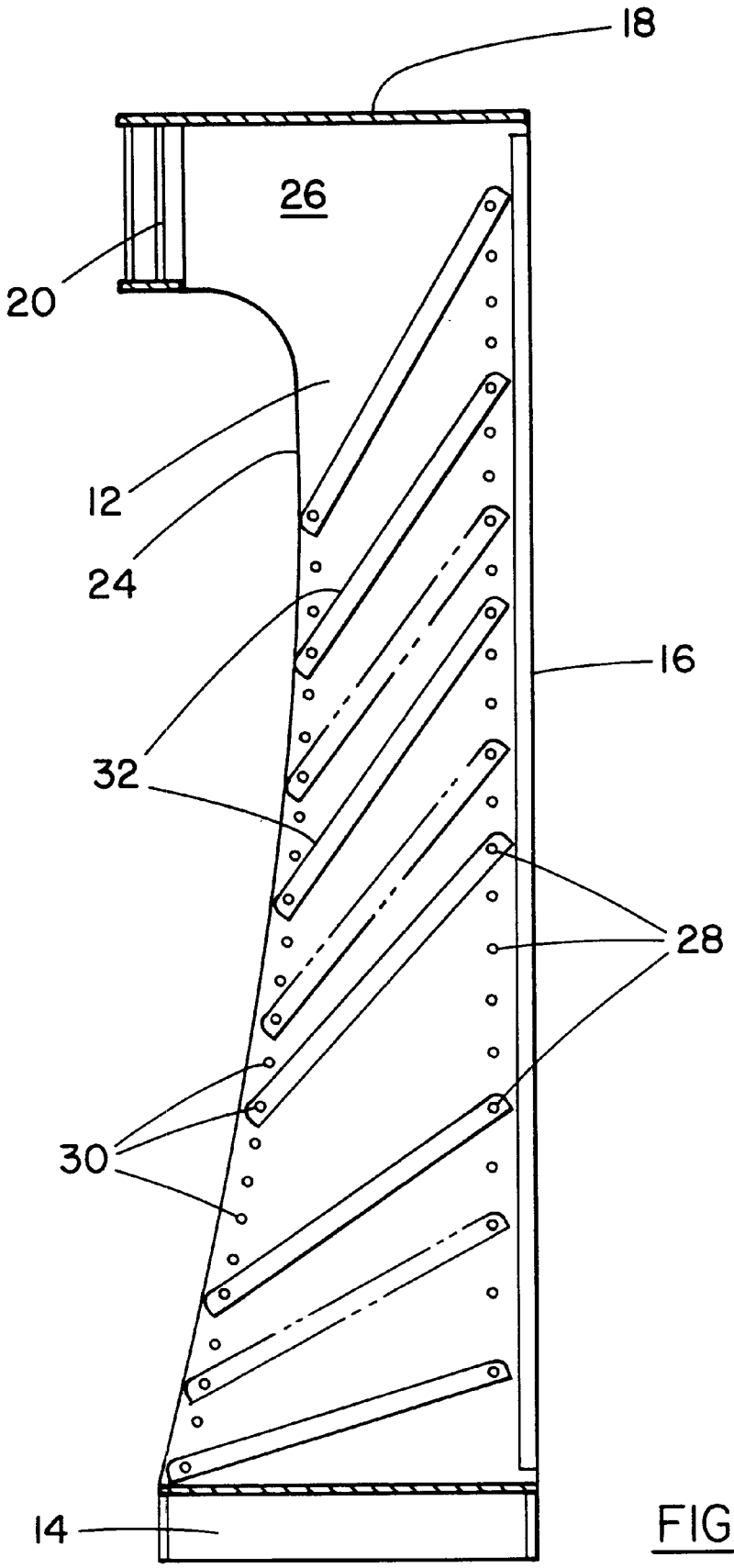
FIG. 2 is a section along the line 2—2 of FIG. 1 showing some of the trays in solid form and others in phantom, and showing the progressively increasing angling of the trays as they go up from the bottom to the top of the display.

Referring first to FIGS. 1 and 2, it will be seen that the drawings, as has already been mentioned, relate to a free-standing in-store display indicated generally as 10. While reference is made to a "free-standing" display, it will be appreciated that it could conceivably be mounted against a wall and fixed in position, if that were desired, although it is believed that its greatest advantages will be achieved as a free standing display that can be placed at various locations around the floor of a retail space. However, the use of a fixed display 10 is not excluded. The display is illustrated here for the purpose of explaining the invention.

The display unit comprises a pair of side walls 12—12, a bottom panel 14, extending between the two side walls 12, and a top or canopy 18, having a forward header wall 20.

The two side walls 12 have linear rear edges 22, and generally curved forward edges 24. In this particular embodiment, the forward edge 24 curves in a generally arcuate concave rearward manner from the lower end to the upper end causing the lower ends of the side walls 12 to be wider than the upper ends of the side walls 12. In this particular embodiment at the upper end the side walls 12 are formed with generally L-shaped extensions 26, which support the top or canopy 18 and the forward header 20.

The side walls 12 are provided on their inwardly facing sides with a plurality of support pins 28 and 30, which are secured at spaced apart intervals along the rear and forward edges of the side walls 12. The pins may be fixed in position. The pins 28 along the rearward edge are arranged along a generally linear vertical axis. The pins 30 along the forward edges of the side walls 12, are arranged along a generally curved axis corresponding to the curvature of the front edge 24 of the side walls 12. It will thus be seen that the pins 28 and 30 at the lower ends of the side walls 12 are further apart and the pins 28 and 30 at the upper end are closer together, for reasons which will be described below.

Figure 3:
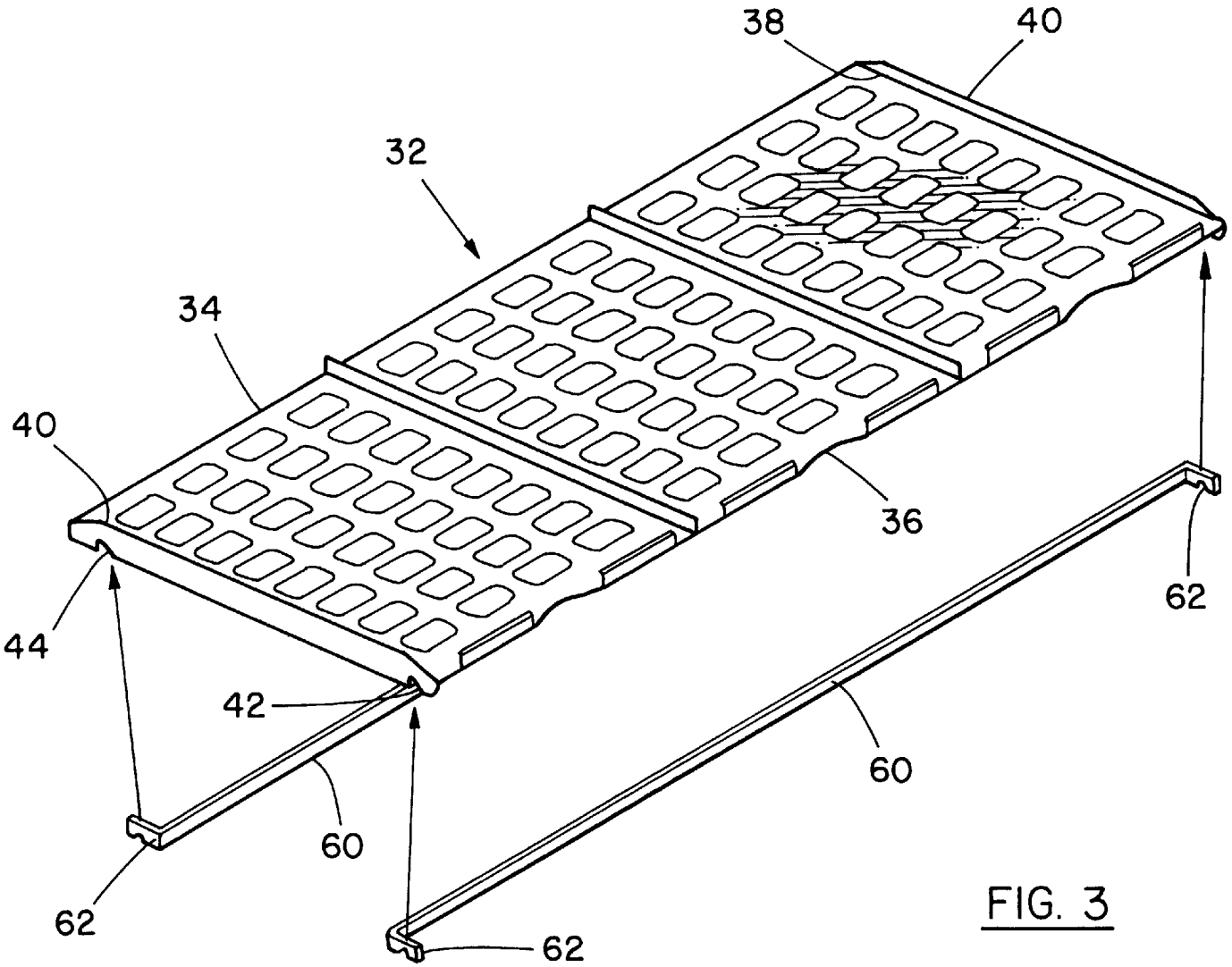
FIG. 3 is a perspective illustration of a tray for use in the display illustrating the invention as illustrated in FIGS. 1 and 2 partly exploded.
Figure 4:
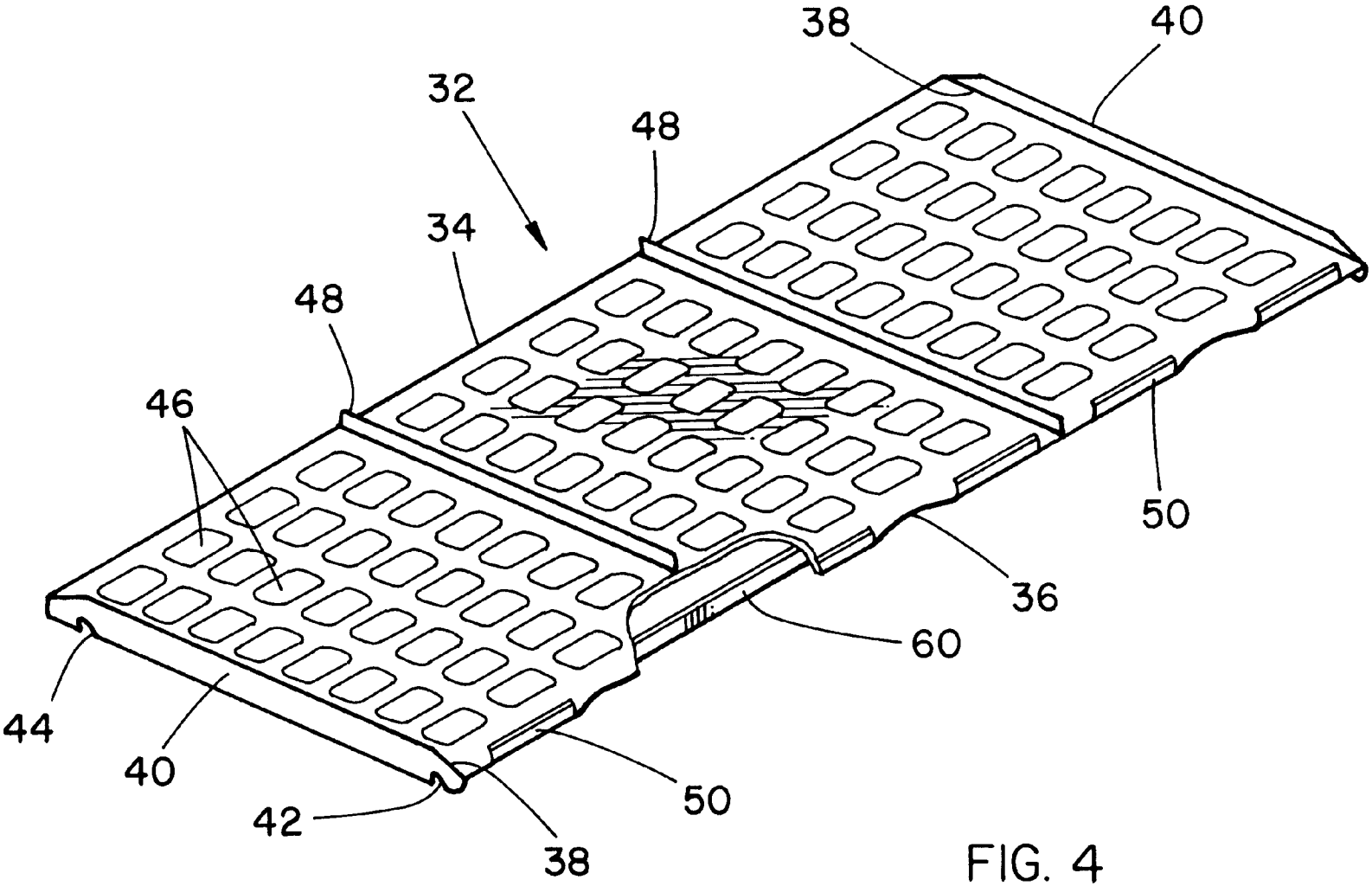
FIG. 4 is a cut away perspective of the tray of FIG. 3.
Figure 5:
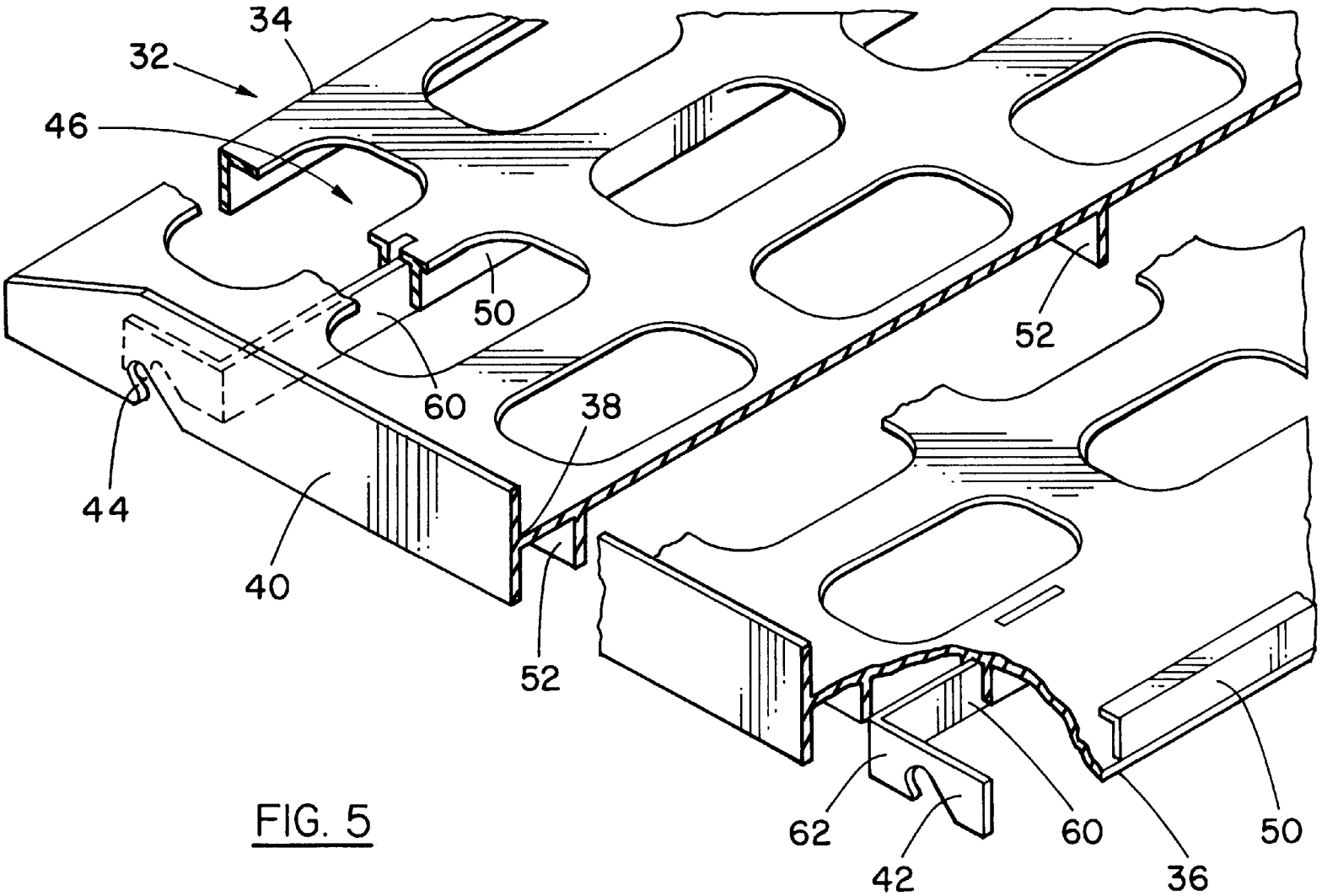
FIG. 5 is an enlarged perspective of one end of a shelf, partially cut away.

The shelves or trays are indicated generally as 32. The shelves 32 (FIGS. 3, 4 and 5), have a rear edge 34 and a forward edge 36, and end edges 38.

Along the end edges 38, there are formed generally vertical end walls. Forward and rear retention recesses 42 and 44 are formed in the end walls 40, and are arranged to engage the support pins 28 and 30 on the side walls 12, in the manner shown in FIG. 2.

The shelves or trays are formed of injection moulded thermoplastic material and are formed with a large plurality of generally rectangular openings 46 to reduce weight. A pair of intermediate spacer walls 48 are formed from front to rear of the trays 32, and forward product retention flanges 50 are formed along the forward edge 36, for retaining product and preventing it from sliding off.

Beneath the trays 32, there are provided elongated longitudinal reinforcement walls 52, and there are a plurality of transverse front to rear reinforcement walls 54 at spaced intervals.

To provide additional strengthening and support lengthwise along the trays, there are provided two elongated metal support bars 60—60, having end flanges 62 bent around, inside end walls 40, and having flange notches registering with the notches 40 in the end walls of the trays.

In this way the length wise support bars provide substantial support across the length of the trays, for supporting heavier products.

As shown in FIGS. 1 and 2, the shelves 32 are placed in position, from bottom to top of the side walls, and it will be seen that the shelves 32 by engaging with the pins 28 and 30 which are progressively closer together as they go from the bottom to the top of the side walls, will cause the shelves 32 to gradually tilt further and further forward, until they are angled almost up to about 60 degrees, at the very top.

Product such as, vinyl tiles T (FIG. 1), may be placed on the shelves 32. The product will then be readily visible to prospective purchasers, being displayed on all of the shelves simultaneously.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shelf system for displaying shelves of products at varying angles and comprising;

a base;

a back wall;

side walls defining lower and upper regions;

a plurality of forward support pins on the side walls;

a plurality of rear support pins on the side walls;

wherein the pairs of forward and rear pins on the lower regions of side walls are aligned at a slight angle to wherein horizontal and the pairs of forward and rear pins on the upper region of the side walls are aligned at angles which are at progressively steeper angles; and, shelves formed of a uniform construction interengaged with respective pairs of forward and rear support pins on the side wall, wherein the shelves tilt at progressively increasing angles from the lower region to the upper region of the side walls;

said shelves being formed of injection moulded thermoplastic material, and defining ends adjacent respective said side walls;

end edge walls at each end of each of said shelves extending downwardly below said shelves;

edge notches formed in said end edge walls below said shelves for engaging said support pins on said side walls of the display;

transverse reinforcing ridges located on the underside of said shelves;

retaining portions on the forward edges of the shelves;

metallic support bars on the underside of said shelves adjacent their forward and rear edges, spanning the length of said shelves;

L-shaped flange portions at the ends of said support bars located beneath said shelves, and lying within said end edge walls; and, flange notches in said flange portions of said support bars registering with said edge notches in said end edge walls of said shelves for engaging said support pins on said side walls.

2. A shelf system as claimed in claim 1 wherein the forward edges of the side walls have a concave arcuate profile.

3. A shelf system as claimed in claim 1 including a canopy provided on top of the side walls, to provide a finished attractive appearance to the display.

4. A shelf system as claimed in claim 1 and including longitudinal reinforcing ribs moulded integrally with said shelves, and located on the underside of said shelves.

5. A shelf system as claimed in claim 1 wherein the side walls are formed in a generally upwardly tapering fashion, having a rear edge which is vertical, and having a forward edge which tapers from a wide region at the base to a narrower region at the top.

6. A shelf system as claimed in claim 5 wherein the forward support pins follow the tapering of the forward edge of the side walls.

7. A shelf system as claimed in claim 6 wherein the rearward pins are aligned in a linear fashion following the linear shape of the rear edge of the side walls, whereby the lower shelves are supported at a relatively low angle, and each succeeding upper shelf will then be supported at a progressively steeper angle.

8. A shelf system for displaying shelves of products at progressively varying angles which vary from a shallow angle at the lowermost shelf to progressively steeper angles in each succeeding higher shelf from lower to upper shelves in such system and comprising;

a base;

a back wall;

side walls defining lower and upper regions;

rear edges on said side walls which are substantially upright;

forward edges on said wide walls which are contoured concavely rearwardly from bottom to top;

a plurality of rear shelf support pins on the side walls, arranged along rear pin axes which are generally parallel to said rear edges of said side walls;

a plurality of forward shelf support pins on the side walls, arranged along forward pin axes which are contoured to correspond to the rearward concave contouring of said forward edges of said side walls;

wherein pairs of forward and rear pins are arranged one above the other, and wherein the lowermost pairs of forward and rear pins define shelf tilt angles at a first predetermined angle, and wherein each of the ascending pairs of said forward and rear pins define progressively steeper shelf tilt angles from the lowermost regions of the side walls to the uppermost region of the side walls.

* * * * *